US008083241B2

(12) United States Patent
Corrente

(10) Patent No.: US 8,083,241 B2
(45) Date of Patent: Dec. 27, 2011

(54) SKATEBOARD SUSPENSION APPARATUS

(76) Inventor: Christopher Robert Corrente, Oceanside, CA (US)

( * ) Notice: Subject to any disclaimer, the term of this patent is extended or adjusted under 35 U.S.C. 154(b) by 87 days.

(21) Appl. No.: 12/315,563

(22) Filed: Dec. 4, 2008

(65) Prior Publication Data

US 2010/0140885 A1 Jun. 10, 2010

(51) Int. Cl.
*B62M 1/00* (2010.01)

(52) U.S. Cl. ..... 280/87.042

(58) Field of Classification Search ..... 280/87.041, 280/87.042

See application file for complete search history.

(56) References Cited

U.S. PATENT DOCUMENTS 4,152,001 A * 5/1979 Christianson ..... 280/11.28
4,155,565 A * 5/1979 de Caussin et al. ..... 280/87.042
4,176,850 A 12/1979 Johnson
4,184,693 A 1/1980 Whitmarsh
4,185,847 A 1/1980 Johnson
5,263,725 A 11/1993 Gesmer
6,318,739 B1 * 11/2001 Fehn, Jr. ..... 280/11.28
6,367,819 B1 4/2002 Andersen
6,474,666 B1 11/2002 Anderson
6,523,837 B2 2/2003 Kirkland
6,536,788 B1 3/2003 Kuncz
6,547,262 B1 4/2003 Yamada
6,793,224 B2 9/2004 Stratton
6,913,272 B2 7/2005 Chang
6,932,362 B1 8/2005 Barrett
6,979,007 B1 * 12/2005 Hosoda ..... 280/87.042
7,007,977 B1 3/2006 Gallagher
7,044,485 B2 5/2006 Kent
7,070,193 B2 7/2006 Yamaguchi
7,093,842 B2 * 8/2006 Chmelar ..... 280/87.042
7,104,558 B1 9/2006 Saldana
7,121,566 B2 10/2006 McClain
7,150,460 B2 12/2006 Williams
7,192,039 B1 3/2007 Snedaker
7,232,139 B2 6/2007 Cole
7,243,925 B2 7/2007 Lukoszek
7,287,762 B2 10/2007 Stratton
7,374,179 B2 5/2008 Cole
7,413,200 B2 8/2008 Horn
2006/0061054 A1 * 3/2006 Grossman ..... 280/87.042
2007/0114744 A1 * 5/2007 Mash ..... 280/87.042

* cited by examiner

*Primary Examiner* — J. Allen Shriver, II
*Assistant Examiner* — Erez Gurari

(57) ABSTRACT

A skateboard kit for a skateboard having a skateboard deck and a skateboard truck is provided and includes an extension member structured to couple to the skateboard deck, with a first section of the extension member positionable at an original skateboard truck mounting position on the skateboard deck, and a second section of the extension member comprising a new skateboard truck mounting position, with the second section angled relative to the first section so that when the skateboard truck is coupled to the new skateboard truck mounting position on the second section, the skateboard truck is positioned at an angle relative to the original skateboard truck mounting position and also located at a different skateboard deck lengthwise location from the original skateboard truck mounting position.

10 Claims, 11 Drawing Sheets

SKATEBOARD SUSPENSION APPARATUS

FIELD OF THE INVENTION

The present invention generally relates to skateboards. More particularly, the invention concerns a suspension apparatus for a skateboard.

BACKGROUND OF THE INVENTION

The sport of skateboarding began in the 1960's as an offshoot of surfing. Because skateboards can be used just about anywhere, such as streets and sidewalks, and are not limited to coastal areas with decent surf, it has eclipsed the popularity of surfing many times over both in terms of numbers of participants and size of the industry. As would be expected with such a developed sport, skateboards and their components have evolved over the four decades or so since the first person took the wheels off an old pair of roller skates and put them on the underside of a piece of wood.

The modern skateboard comprises several basic components, including a riding surface, or deck, usually made of an elongated piece of wood, fiberglass or some other sturdy, resilient and sometimes flexible material, four wheels with some sort of ball bearing arrangement upon which the deck and rider are transported, and two skateboard trucks, where the trucks are the devices by which the wheels are connected to the deck. The trucks are attached to the deck in a mirror image manner, such that as a user leans on one side of the skateboard, the forces cause each truck to simultaneously steer in the opposite direction that the other truck steers. While located in a fairly unobtrusive location on the underside of the deck, the trucks are very important as they determine how the skateboarder controls his/her skateboard by determining how a skateboard's wheels turn.

Skateboard trucks have several basic components, within which there can be some variation. The basic components of the modern skateboard truck include a base plate or a truck mounting plate that is fastened to the bottom of the deck. The base plate also includes a pivot cup that receives a pivot pin that extends from a "hanger" that comprises the top portion of the truck and houses an axle for mounting the wheels. A bolt, or kingpin attaches the hanger to the base plate, and usually includes at least two kingpin bushings that allow movement of the hanger about the pivot pin. The ease of movement is generally adjusted by a kingpin nut threaded onto the end of the kingpin.

Specifically, the kingpin extends through a ring in the hanger that includes an oversized hole for the kingpin. Generally, two kingpin bushings are located about the kingpin, one on either side of the hanger ring, with the kingpin nut securing the kingpin bushings. The kingpin bushings are usually made of plastic components such as urethane, and by tightening the kingpin nut it becomes more difficult to pivot the hanger, and therefore more difficult to turn the skateboard. That is, tightening the kingpin nut generally tends to make the skateboard more stable and less susceptible to "wobble" at higher speeds, resulting in an undesirable trade-off between a user's desire for skateboard maneuverability versus stability at higher speeds.

It is apparent that existing skateboard trucks limit the turning ability of the skateboard as they allow unacceptably small axle deflection unless the rider loosens the bushings so much that the board develops an undesirable wobble at higher speeds.

Therefore, there remains a need to overcome one or more of the limitations in the above-described, existing art. The discussion of the background to the invention included herein is included to explain the context of the invention. This is not to be taken as an admission that any of the material referred to was published, known or part of the common general knowledge as at the priority date of the claims.

Figure 1:
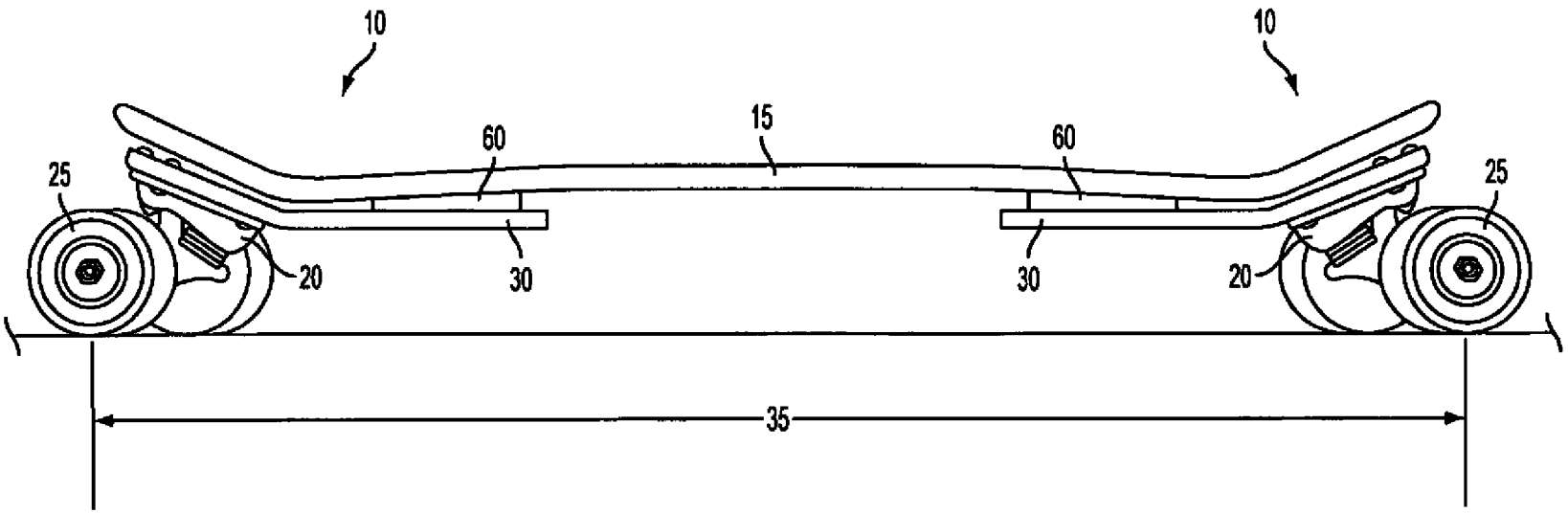
FIG. 1 is a perspective view of one embodiment of the skateboard suspension system as attached to a skateboard deck.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE PREFERRED EMBODIMENTS

In the following description, for the purposes of explanation, numerous specific details are set forth in order to provide a thorough understanding of the skateboard suspension system ("SSS") of the present invention. It will be apparent, however, to one skilled in the art that the skateboard suspension system may be practiced without some of these specific details. Throughout this description, the embodiments and examples shown should be considered as exemplars, rather than as limitations on the skateboard suspension system. That is, the following description provides examples, and the accompanying drawings show various examples for the purposes of illustration. However, these examples should not be construed in a limiting sense as they are merely intended to provide examples of the skateboard suspension system rather than to provide an exhaustive list of all possible implementations of the skateboard suspension system.

Specific embodiments of the skateboard suspension system will now be further described by the following, non-limiting examples which will serve to illustrate various features. The examples are intended merely to facilitate an understanding of ways in which the skateboard suspension system may be practiced and to further enable those of skill in the art to practice the invention. Accordingly, the examples should not be construed as limiting the scope of the invention.

As discussed in the Background, the current skateboard truck consists of a hanger, base plate, an axle (which may be sold with wheels), and a kingpin to which a kingpin threaded hex nut is attached to capture and distribute tension to two polyurethane bushings or grommets that capture the hanger. There is continual development of these polyurethane grommets in an attempt to create a truck that allows sufficient hanger rotation, but yet also limits the same rotation, thereby preventing "wheel bite" where the wheel contacts the deck, causing an undesirable braking action due to friction between the deck and the wheel.

So, in addition to the problems discussed in the Background, skateboards suffer from the following problems: 1) wheel bite; 2) lack of turning capability; 3) instability while turning; 4) instability due to the height of the deck (i.e., high center of gravity); and 5) wheels that slide or break free from small bumps (i.e., lack of grip).

The skateboard suspension system ("SSS") described herein is comprised of individual parts that mount to any skateboard, and addresses the above-listed problems. The SSS mounts to any skateboard, uses the existing trucks, wheels, and deck of the existing board, and also uses the existing holes in the deck, and corrects the shortcomings of the contemporary skateboard.

Figure 6A:
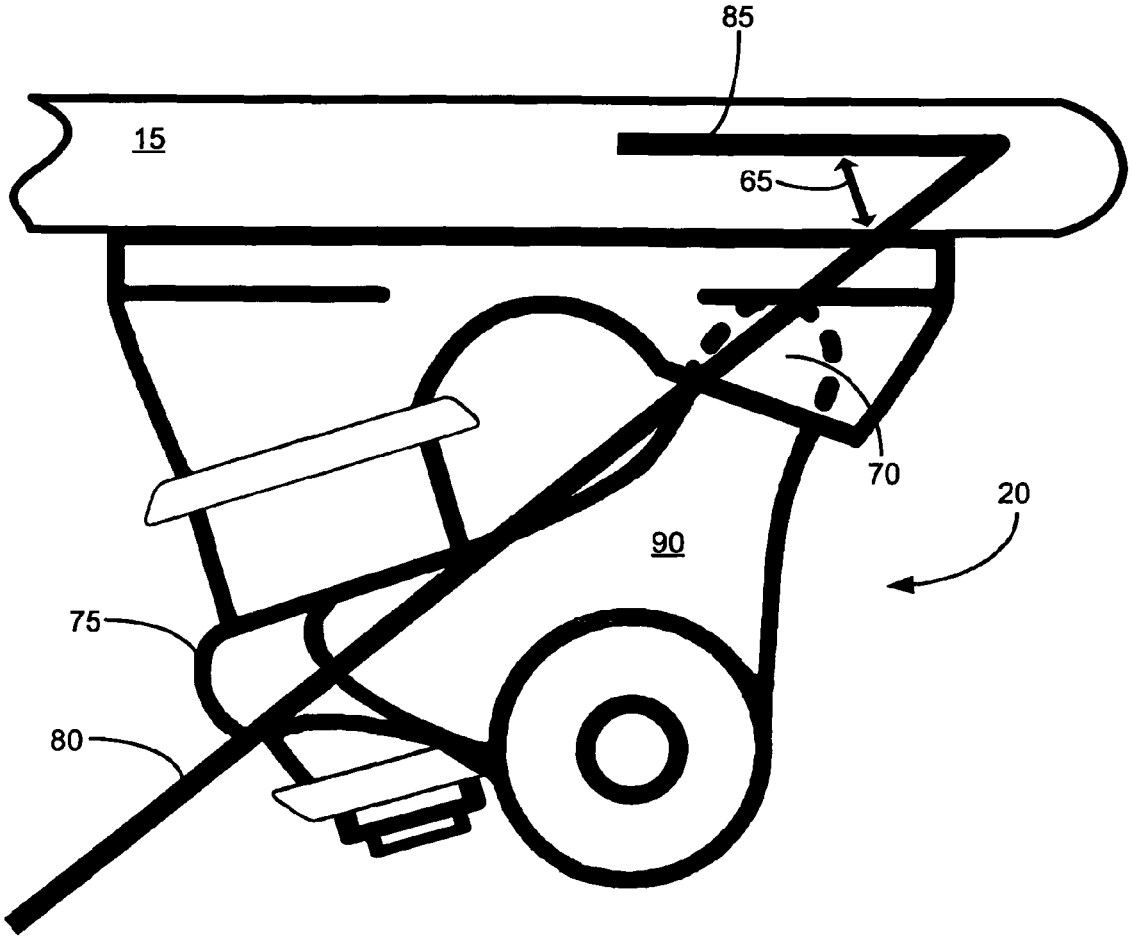
FIG. 6A is a side elevation view of a skateboard truck and deck illustrating an action angle.
Figure 6B:
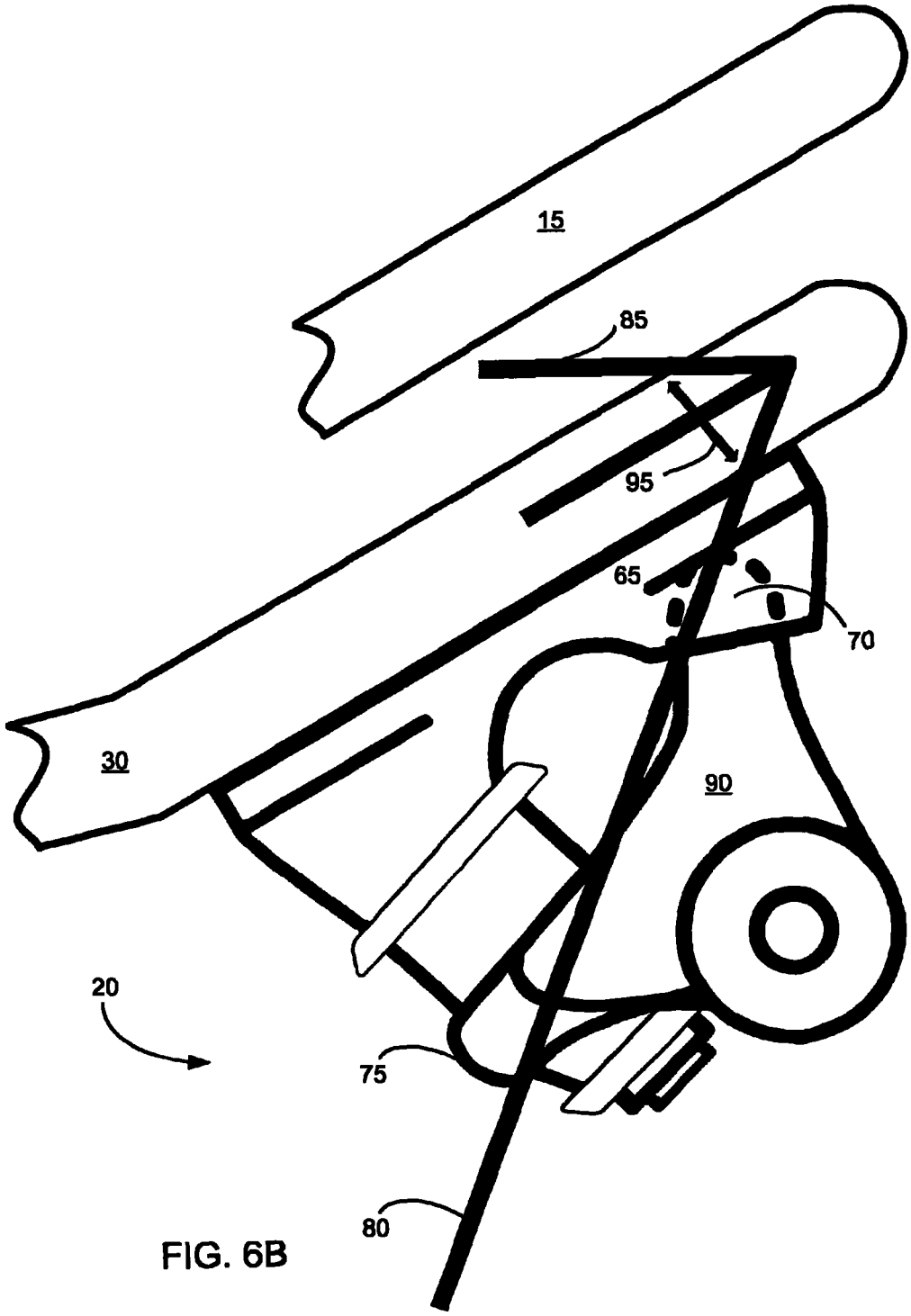
FIG. 6B is a side elevation view of a skateboard truck, deck and plank illustrating one embodiment of an skateboard suspension system angle that is greater than the action angle of FIG. 6A.

Referring now to FIGS. 1-4, one embodiment of the skateboard suspension system ("SSS") 10, in the form of a kit, is illustrated mounted to a skateboard. Generally, a complete skateboard comprises a deck 15, two trucks 20, and four wheels 25 mounted to the trucks 20 by bearings. The SSS 10 provides several advantages, one of which is the prevention of wheel bite by placing the skateboard truck 20 on a extension member or plank 30, thus positioning the truck 20 (and wheels 25) further away from the skateboard deck 15, yet because the plank 30 is angled, and the truck 20 is mounted on the angled section of the plank 30, the center of gravity of the skateboard is lowered. In addition, the angled plank 30 angles the truck 20, changing the truck "action angle" (as shown in FIGS. 6A-B), which decreases the turning radius of the skateboard, even though the wheelbase 35 of the skateboard has been increased.

In one embodiment, the plank 30 is an element that attaches to the deck 15 and provides a mount for the truck 25. The plank 30 may be constructed of a variety of materials such as aluminum, wood, fiberglass, plastics, carbon fiber, metal, metal alloys, and other materials that one skilled in the art may employ. In one embodiment the plank 30 may act as a beam that is coupled to the deck 15 and deflects when the wheels 25 encounter irregularities in the terrain, or when a rider "loads" the skateboard while riding. Alternative embodiments of the plank 30 may not deflect under load.

Referring again to FIGS. 1-4, one feature of the SSS 10 is that the wheelbase 35 is increased from the original, or stock skateboard configuration. Generally, the wheelbase 35 is the distance between the axles of the two trucks 20. As shown in FIG. 2, one end, or section of the plank 30 is fastened, or otherwise coupled to the skateboard deck 15 at the location where the trucks 25 were originally attached to the skateboard deck 15 by fasteners 40. The truck 20 is then bolted or otherwise coupled to the other section of the plank 30, and in one embodiment, each plank 30 extends the wheelbase 35 by about 6 inches, creating a total wheelbase 35 increase of about 12 inches for the skateboard. It will be appreciated that the wheelbase increase may vary from skateboard to skateboard, and as discussed below, another embodiment of the SSS 10 includes a plank 30 that can position the truck 20 in a variety of positions, thereby allowing for a variety of wheelbases 35.

For example, in a preferred embodiment, the plank 30 is about 3 inches wide, about 9 inches long, and when constructed of aluminum, may be about 11/32 of an inch thick. The plank 30 comprises two sections, with one section angled relative to the other, as illustrated in FIGS. 1-4. Preferably, the angle is formed approximately 5 inches from one end of the plank 30, with the angled section about 4 inches long. In this embodiment, the angle of the front plank 30 is 20 degrees, and the angle of the rear plank 30 is 18 degrees. As shown in FIG. 4, the plank angle 45 is measured between the bottom of the plank 30 section that is bolted to the deck 15 and the bottom of the section of the plank 30 that receives the truck 20. As discussed below, the plank angle 45 may vary from 18 and 20 degrees, depending upon the desired characteristics of the skateboard. In addition, the location of where the plank angle 45 is formed may also vary, depending upon the proportions of the skateboard deck 15.

Figure 2:
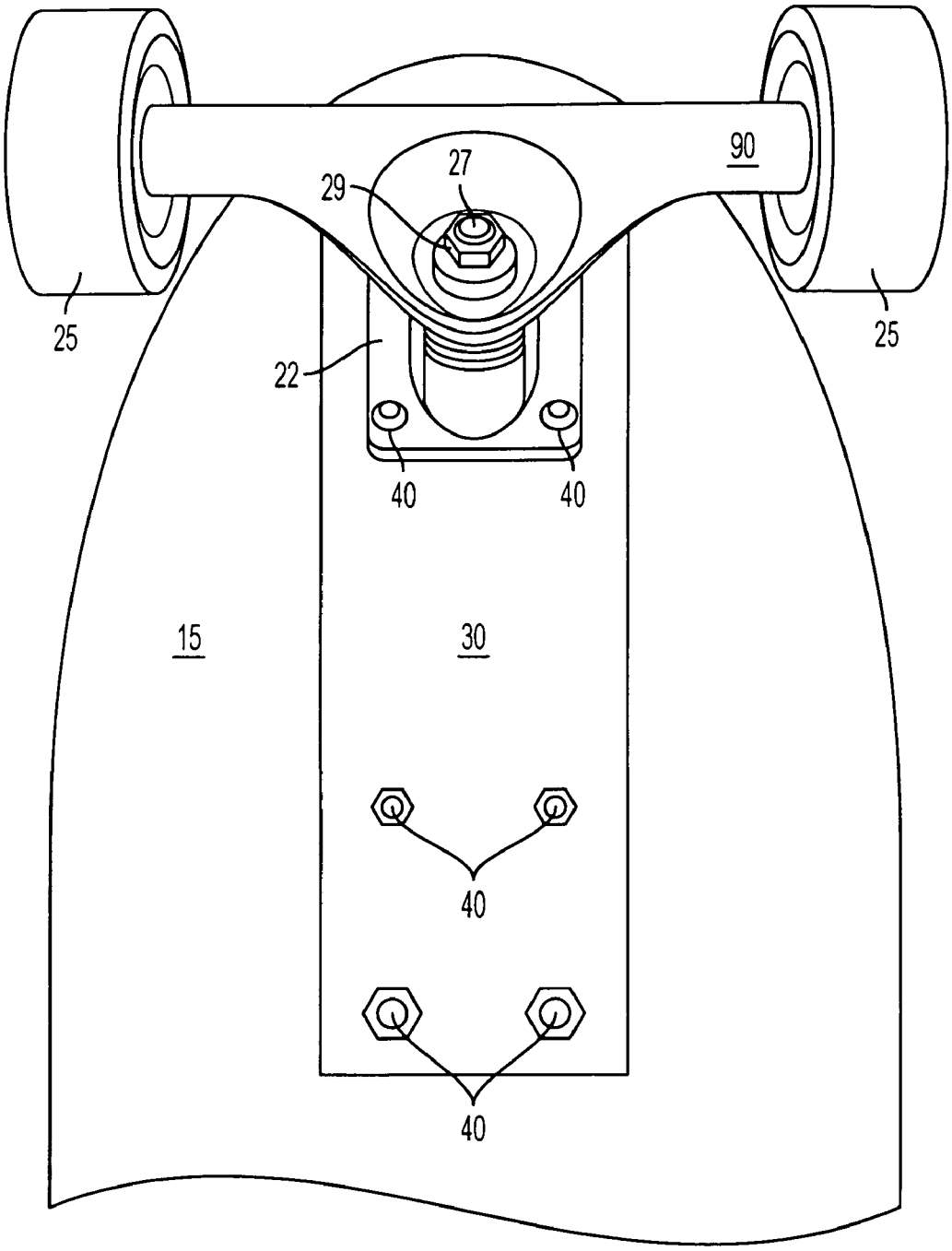
FIG. 2 is a perspective view of a plank of the skateboard suspension system of FIG. 1, attached to a skateboard deck, with a truck and wheels attached thereto.

As shown in FIG. 1, when the two planks 30 are coupled to the skateboard deck 15, the wheelbase 35 is increased. In addition, the center of gravity of the skateboard is lowered. That is, the center of mass of the skateboard is closer to the ground, or terrain. This is because the trucks 20 are now mounted to the angled section of the planks 30, which positions the deck 15 closer to the ground. The center of gravity of many conventional skateboards is too high, resulting in an unstable riding feeling. But, if the deck height is lowered, the skateboard suffers from wheel bite. The SSS 10 repositions the trucks 20 outward, toward each end of the deck 15. However, the trucks 20 do not contact the deck 15 due to their angled mounting position on the planks 30 (described in detail below). Thus, the SSS 10 produces a skateboard that does not feel as tall, and therefore, feels more stable to the rider.

As mentioned above, and as shown in FIG. 1, when the two planks 30 are coupled to the skateboard deck 15, the wheelbase 35 is increased. With the wheelbase 35 increased, the skateboard deck 15 generally flexes or deflects more than the original wheelbase, and the skateboard is more stable. The increased flex helps the deck 15 to absorb shocks and bumps encountered by the wheels 25, which helps to keep the wheels 25 in contact with the terrain, or ground, thereby minimizing or eliminating any skidding or sliding with the resultant loss of control. In this way the SSS 10 increases rider safety, comfort and confidence.

Figure 3:
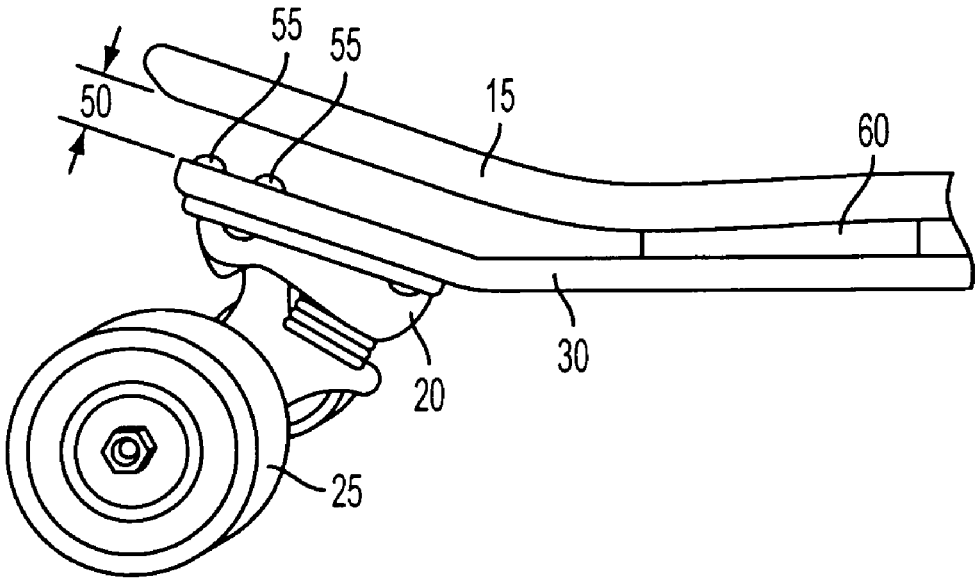
FIG. 3 is a another perspective view of the skateboard suspension system of FIG. 1, showing another view of the plank, truck and wheels illustrated in FIG. 2, and also showing a deflection gap between the skateboard deck and the plank.
Figure 4:
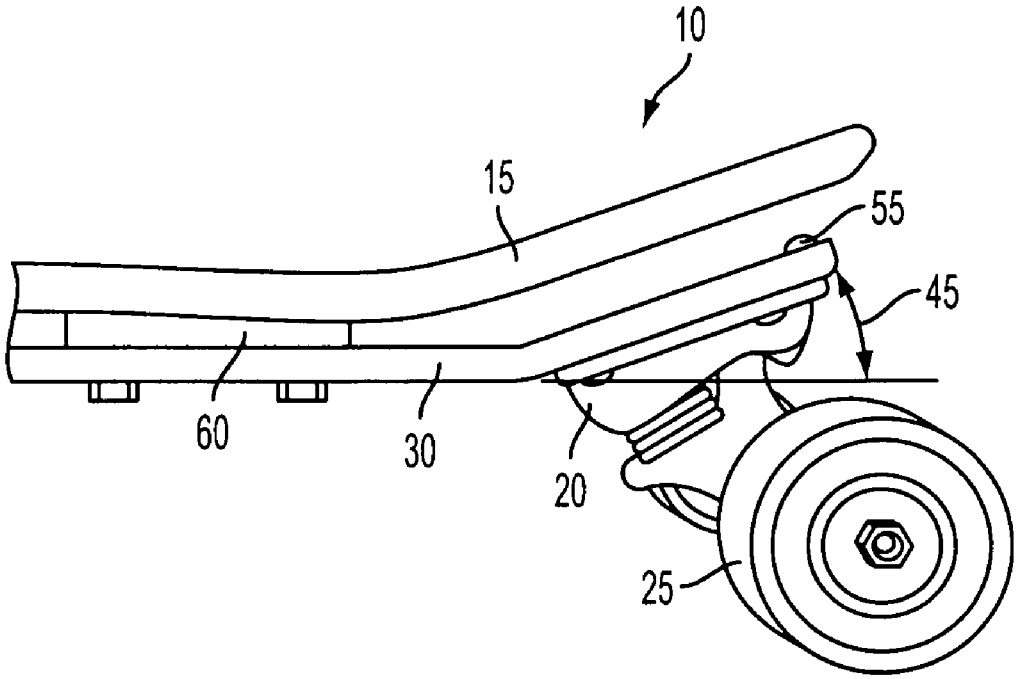
FIG. 4 is a another perspective view of the skateboard suspension system of FIG. 1, showing the plank illustrated in FIGS. 2 and 3 coupled to the skateboard deck with a riser pad.

Referring now to FIG. 3, another feature of the SSS 10 is illustrated. As shown, a deflection gap 50 is located between the angled section of the plank 30 and the deck 15. In one embodiment, compressible elements, or gap pads 55 are positioned on the plank 30, and face the deck 15. When a bump or other terrain irregularity is encountered, the plank 30 deflects, absorbing the energy of the bump, thereby allowing the wheels 25 to remain in contact with the terrain, much like a shock absorber on an automobile. If the bump is severe, the gap pads 55 will contact the deck 15, and in a preferred embodiment, compress or "squish" and absorb at least a portion of the bump's energy. In one embodiment, the gap pads 55 comprise adhesive-backed vinyl, or plastic buttons, but it will be appreciated that the gap pads 55 may be constructed of polymers, polyesters, silicone, silicone rubber, rubber, polyurethane, and other materials. Also, the gap pads 55 may also be constructed as a single piece (i.e., a single gap pad), and extend across at least a portion of the width of the plank 30. The deflection gap 50 may range from as little as ⅛ of an inch on some skateboards to as much as ¾ of an inch, depending on the particular shape of the skateboard deck 15. The deflection gap 50, gap pads 55 and increased flex of the deck 15 from the wheelbase 35 increase, all combine to provide a "suspension" for the skateboard that absorbs shocks and enables the wheels 25 to remain in contact with the terrain, increasing rider safety and confidence.

As shown in FIG. 4, a riser pad 60 may be used in another embodiment of the SSS 10. The riser pad 60 is located between the deck 15 and the plank 30 and is used to form the deflection gap 50 on skateboard decks 15 having a non-standard shape. The riser pad 60 may be rectangular in shape, or may have surfaces that are not parallel to each other. In addition, the riser pad 60 may be constructed of a substantially rigid material, or may be constructed from a substantially non-rigid material that may absorb shocks and vibrations.

Figure 5:
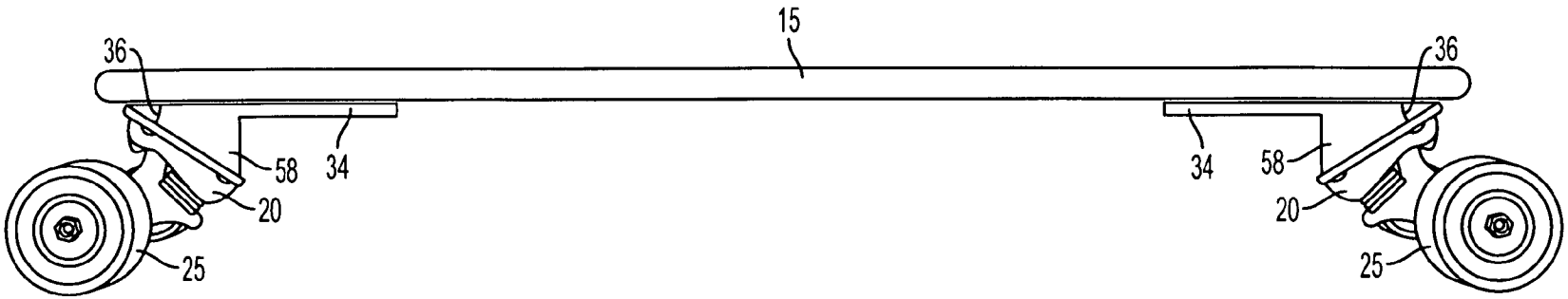
FIG. 5 is a perspective view of another embodiment plank attached to a skateboard deck, with a truck and wheels attached thereto.

Referring now to FIG. 5, another embodiment straight plank 34 is illustrated. In this embodiment, the surface of the straight plank 34 that is coupled to the skateboard deck 15 is not angled. Instead, the plank distal end 58 includes a wedge-shaped section where the skateboard truck 20 is mounted, or coupled by fasteners 40 (not shown). The end of the straight plank 34 opposite the plank distal end 58 is coupled to the skateboard deck 15 at the location where the trucks 20 were originally attached to the skateboard deck 15 by fasteners 40. This embodiment straight plank 34 is about 3 inches wide, about 7 inches long, and the distal end angle 36 of the straight plank 34 mounted to the front of the skateboard is 20 degrees, and the distal end angle 36 of the straight plank 34 mounted to the rear of the skateboard is 18 degrees. As discussed below, the distal end angle 26 may vary from 18 and 20 degrees, depending upon the desired characteristics of the skateboard, and the width, length and thickness dimensions of the straight plank 34 may also vary.

Referring now to FIGS. 6A and 6B, another feature of the SSS 10 is illustrated. FIG. 6A illustrates a truck 20 mounted to a deck 15 that is substantially parallel to the ground or terrain. This is the prevailing arrangement of conventional skateboards. Truck 20 geometry, or design affects the skateboards turning and stability characteristics. One way to explain truck 20 geometry is to discuss the "action angle" 65 of the truck 20. As shown in FIG. 6A, the action angle 65 is the angle formed between a line drawn from the tip of the pivot stem 70 through the center of the hanger ring 75 (the "truck line" 80), and a line parallel to the ground on which the skateboard travels (the "horizontal line" 85). The hanger 90 pivots about the truck line 80. The larger the action angle 65, the more the hanger 90 pivots for a given amount of deck 15 tilt and the smaller the turning radius. As shown in FIG. 6B, the truck 20 is mounted to the angled section of the plank 30, the total amount of the action angle 65 is now SSS angle 95. That is, because the truck 20 is now angled relative to the horizontal line 85, SSS angle 95 is greater than the action angle 65. As a result, the SSS angle 95 increases the hanger 90 pivot for a given amount of deck 15 tilt and decreases the turning radius of the skateboard.

A preferred embodiment of the SSS 10 employs a different SSS angle 95 for each truck 20. The preferred embodiment increases the action angle 65 by 20 degrees on the plank 30 mounted on the front of the skateboard, and increases the action angle 65 by 18 degrees on the plank 30 mounted on the rear of the skateboard. As discussed above, increasing the action angle 65 increases the hanger 90 pivot for a given amount of deck 15 tilt and also reduces the turning radius of the skateboard. Therefore, the front truck 20, having a 20 degree action angle 65 increase, turns faster than rear truck 20, which only has a 18 degree action angle 65 increase. As a result, the rear truck 20 "trails" the front truck 20 and, due to the 2 degree difference, the front truck 20 turns quicker than the rear truck 20. This combination produces a skateboard that has a stable ride.

It will be appreciated that other embodiments are envisioned that vary the SSS angle 95. The SSS angle 95 may vary due to several factors, including the action angle 65 of the truck 20, which varies among manufacturers, the desired characteristics of the skateboard, and other factors. The following Table 1 illustrates just a few different envisioned embodiments of SSS angle 95 for the truck 20 mounted on the front and rear of a skateboard.

TABLE 1

| Rear Truck | Front Truck | Resulting "feel" |
|---|---|---|
| 18 degrees | 22 degrees | Single Fin Shortboard |
| 18 degrees | 21 degrees | Twin Fin Shortboard |
| 18 degrees | 20 degrees | Standard Shortboard |
| 18 degrees | 19 degrees | Big Wave Gun |
| 18 degrees | 18 degrees | Snowboard |
| 17 degrees | 20 degrees | Longboard |

The above Table 1 illustrates how the SSS 10 can create a skateboard that mimics a particular surfboard or snowboard feel. In addition, another embodiment of the SSS 10 may use a riser pad 60, illustrated in FIG. 4, to directly mount the truck 20 to the angled end of a skateboard deck 15. Many conventional skateboard decks 15 have ends that are angled, as shown in FIGS. 1, 3 and 4. Generally, the deck 15 ends are angled about 25 degrees. One embodiment SSS 10 comprises a "reverse" riser pad 60 that can be mounted to the angled portion of the deck 15. In one embodiment, the front riser pad 60 would have a −5 degree angle, resulting in an action angle 65 increase of 20 degrees, with the rear riser pad 60 having a −7 degree angle, resulting in an action angle 65 increase of 18 degrees. As discussed above, other action angle 65 changes are contemplated, which are achieved by producing riser pads 60 with different angles.

One feature of the SSS 10 is that when the truck 20 is coupled to the deck 15 at an angle, the hanger ring 75 is moved toward the ground. The center of the hanger ring 75 is a pivot point of the truck 20 and the closer this point is to the axle (relative to the ground) the lower the center of gravity and the more stable the ride.

Figure 7:
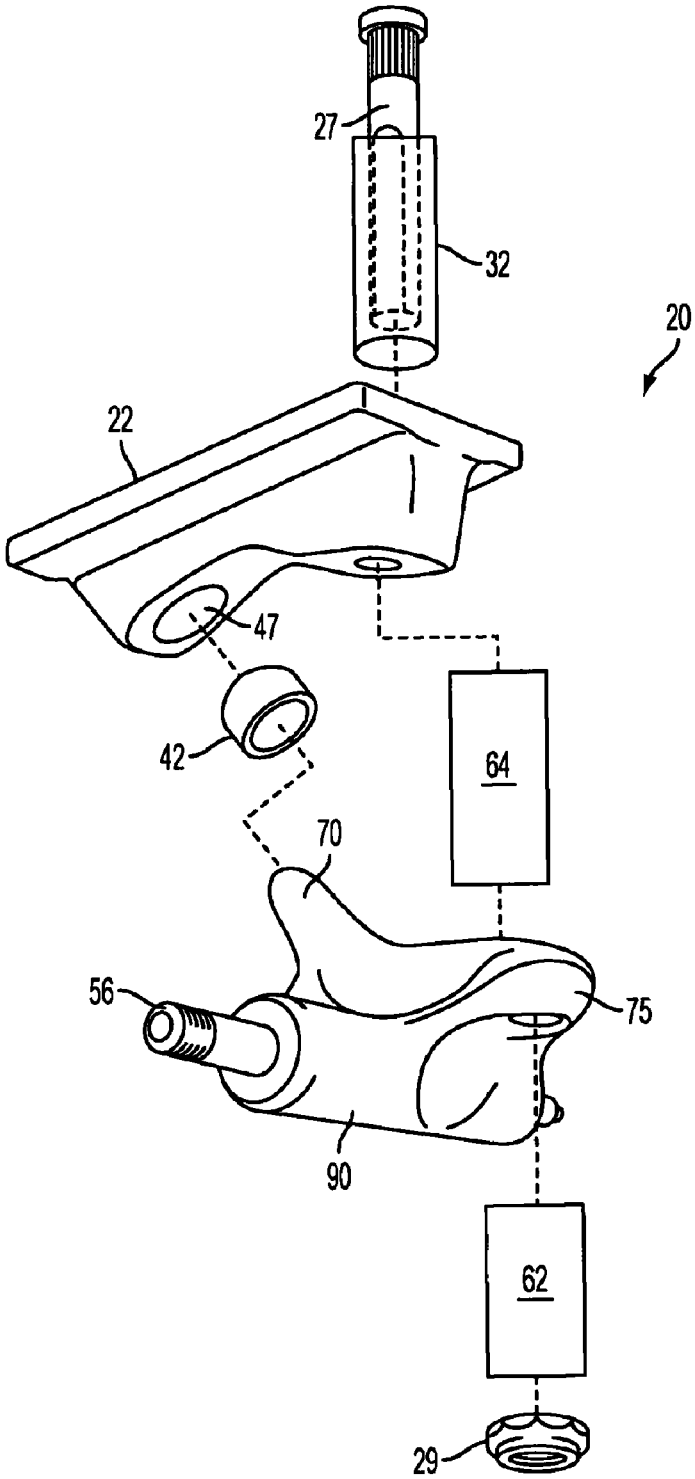
FIG. 7 is an exploded view of a skateboard truck that includes elements of another embodiment of the skateboard suspension system illustrated in FIG. 1.
Figure 8A:
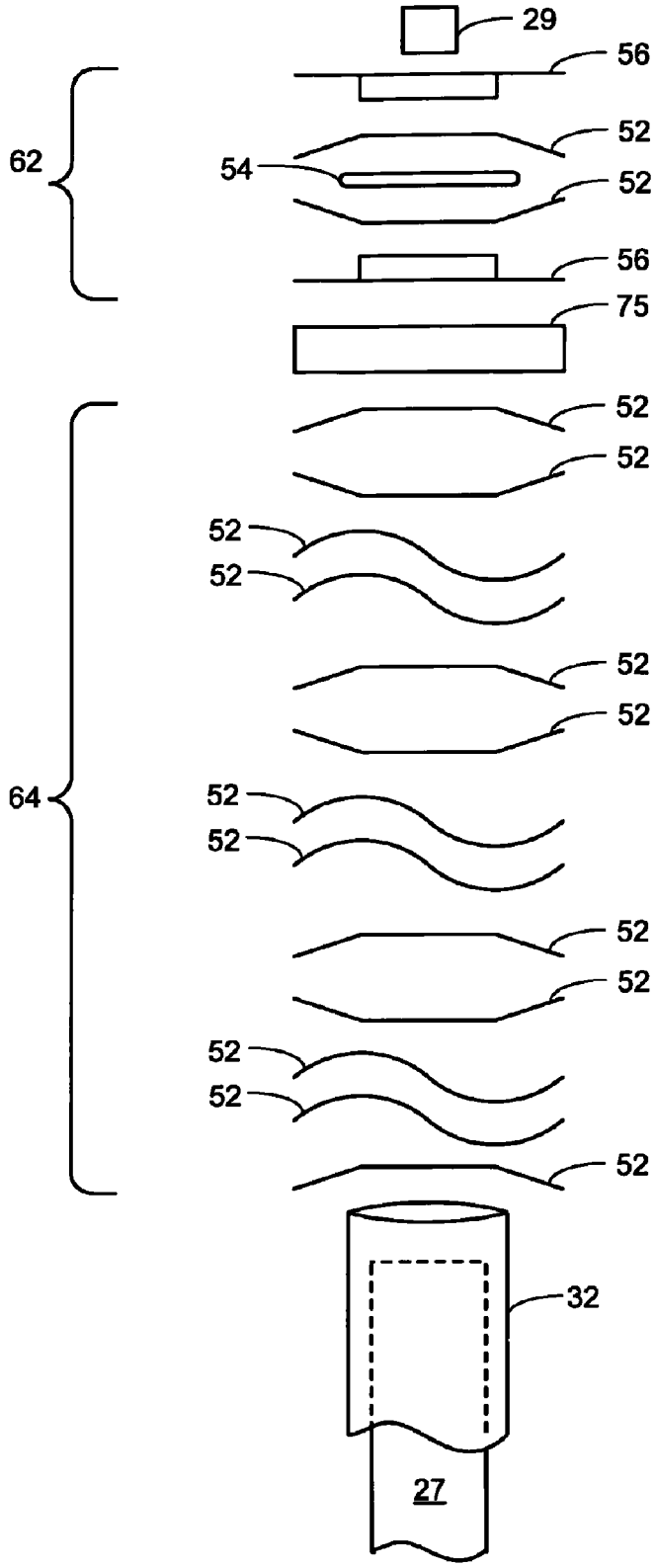
FIG. 8A is an exploded view of a king pin nut set and a truck base plate set for installation on a rear skateboard truck.
Figure 8B:
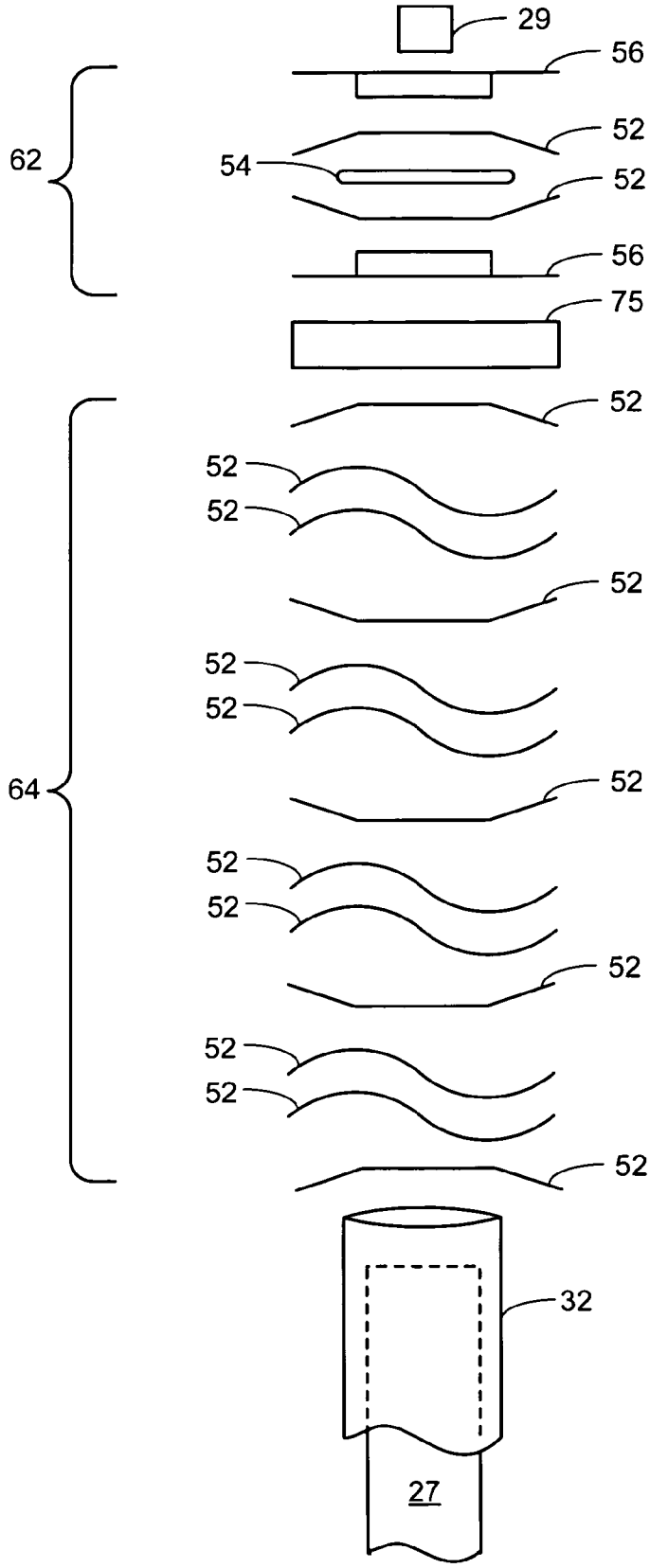
FIG. 8B is an exploded view of a king pin nut set and a truck base plate set for installation on a front skateboard truck.

Referring now to FIGS. 7 and 8A-B, another feature of the SSS 10 is illustrated. As discussed in the Background, conventional skateboard trucks generally employ two kingpin bushings that are located about the kingpin, one on either side of the hanger ring, with the kingpin nut securing the kingpin bushings. The kingpin bushings are usually made of plastic components such as urethane, and are usually about an inch tall, by about an inch in diameter, and by tightening the kingpin nut it becomes more difficult to pivot the hanger, and therefore more difficult to turn the skateboard. That is, tightening the kingpin nut generally tends to make the skateboard more stable and less susceptible to "wobble" at higher speeds, resulting in an undesirable trade-off between a user's desire for skateboard maneuverability versus stability at higher speeds.

The SSS 10 addresses the above problem by utilizing a revolutionary new way of dampening a skateboard truck using an apparatus new to skateboarding. As shown in FIG. 7, one feature of this aspect of the SSS 10 is that it uses many of the components from a conventional skateboard truck, including the truck base plate 22, hanger 90, axle 56, kingpin 27, and kingpin nut 29, however the polyurethane bushings are replaced. The SSS 10 not only solves the issue of wheel bite that has plagued skateboarders, but also clearly surpasses the action and return of any bushing-based method of truck dampening. One feature of this new way of dampening skateboard trucks is that it can be retrofitted to virtually any conventional skateboard truck. The SSS 10 removes the two polyurethane bushings that are positioned about the hanger ring 75 and replaces them with a kingpin sleeve 32, around which an arrangement of non-flat and non-metal washers and springs are placed. In one embodiment, the kingpin sleeve 32 comprises a tube of material having an inner diameter of about ⅜ of an inch, and an outer diameter of about ½ of an inch.

For example, most kingpins 27 on conventional skateboard trucks 20 have an outer diameter of about ⅜ of an inch, so the inner diameter of the kingpin sleeve 32 is sized to match. It will be appreciated that the inner diameter of the kingpin sleeve 32 will vary depending upon the size of the kingpin 27. The outer diameter of the kingpin sleeve 32 is sized to generally match the inner diameter of the non-flat and non-metal washers and springs (discussed below), and in one embodiment, is about ½ of an inch. Again, it will be appreciated that the outer diameter of the kingpin sleeve 32 will vary depending upon the size of the non-flat and non-metal washers and springs. The kingpin sleeve 32 may be constructed of a variety of materials, including plastics, polymers, polyesters, polyolefins, polycarbonates, polyamides, polyethers, polyethylene, polytetrafluoroethylene, silicone, silicone rubber, latex rubber, rubber, polyurethane, polyvinyl chloride, polystyrene, nylon, and other materials.

In addition to the kingpin sleeve 32, a pivot stem sleeve 42 is included in one embodiment of the SSS 10. As illustrated in FIG. 7, the pivot stem sleeve 42 fits about the pivot stem 70 that is pivotally located in truck base plate pivot cup 47. The pivot stem sleeve 42 may vary in size to fit different sized pivot stems 70 found on each manufacturer's skateboard truck 20. The pivot stem sleeve 42 may also be constructed from the same variety of materials as the kingpin sleeve 32.

Referring now to FIGS. 7 and 8A-C, the arrangement and function of the non-flat and non-metal washers will now be described. The non-metal and non-flat washers replace the bushings in conventional skateboard trucks. As defined herein, a washer is a thin plate (typically disk-shaped) with a hole (typically in the middle) that is normally used to distribute the load of a threaded fastener. The non-flat washers employed in the SSS 10 may also be substantially disk-shaped, and include a hole, or aperture substantially in the middle, but are curved (like a Belleville washer or spring washer) and may serve one or more functions, including a spring, preload indicating device, locking device, as well as distributing the load of a threaded fastener.

For example, a variety of combinations of non-flat washers in the SSS 10 are used to generate an increased pivotal action in the hanger 90, yet also allow the hanger 90 to return, or "rebound" expeditiously. Put differently, less effort is required to tilt the deck 15 (i.e., start a turn), which compresses the non-flat washers. But, when the rider begins to end the turn, the compressed non-flat washers exert a spring force that aids the rider in leveling the deck 15. The spring force stored in the compressed non-flat washers provides a stabilizing force that prevents the skateboard from feeling "squirrely" or unstable, resulting in a skateboard feel that is agile, yet stable at the same time. This is unachievable with conventional polyurethane grommets, or bushings, as they do not provide the spring rate, and spring characteristics of non-flat washers.

The SSS 10 may employ a variety of non-flat washers 52. For example, Belleville washers, cupped spring washers, spring washers, conical spring washers, wave washers, disc springs, curved washers or other types of non-flat washers may be employed. In fact any type of non-flat washer 52 that provides a spring force or pre-load may be employed. Different embodiments of the SSS 10 employ a variety of mixed and matched non-flat washers 52 that provide different spring constants and deflections, depending on the desired skateboard characteristic. Also, in another embodiment, non-flat washers 52 in the form of spring washers may be used with flat washers that replace the Belleville washers. Thus, in this embodiment, flat washers and non-flat washers are used in combination.

One embodiment of the SSS 10 is illustrated in FIG. 8A, which illustrates one arrangement of non-metal washers 54 and non-flat washers 52. This arrangement is preferably used on a rear truck 20. Kingpin nut set 62 comprises an arrangement of non-metal washers 54 and non-flat washers 52 that are located between the kingpin nut 29 and hanger ring 75. In a preferred embodiment of the SSS 10, the front truck 20 uses the same kingpin nut set 62. As shown in FIG. 8A, adjacent to the kingpin nut 29 is a shoulder washer 56, with a second shoulder washer 56 located adjacent to the hanger ring 75. Generally, the shoulder washer 56 includes a raised center section around the inner diameter that helps to position and locate the other washers in the kingpin nut set 62. In a preferred embodiment, the shoulder washer 56 is constructed of a non-metal material such as a plastic material. Next to the shoulder washer 56 is a non-flat washer 52, which in a preferred embodiment is a Belleville washer that is positioned with the raised outer diameter facing toward the hanger ring 75. Another non-flat washer 52, which in a preferred embodiment is a Belleville washer, is positioned with the raised outer diameter facing toward the kingpin nut 29. Between the non-flat washers 52 is a substantially flat non-metal washer 54, made of a plastic or other non-metal material that suppresses noise and vibration.

In a preferred embodiment, the Belleville washers each have an inner diameter of about ½ of an inch, an outer diameter of about 1 inch, a curvature height of about 0.092 of an inch and a thickness of about 0.062 of an inch. Generally, this type of Belleville washer requires around 173 pounds of force to compress about 0.030 of an inch. Also, stacking Belleville washers in an alternating direction, as just described, is the same as adding springs in series, resulting in a lower spring constant and greater deflection. It will be appreciated that the dimensions of the Belleville washers may vary, depending upon the varying truck 20 assemblies and desired skateboard characteristics.

Again referring to FIG. 8A, the truck base plate set 64 is now described. Directly adjacent to the hanger ring 75 is a non-flat washer 52, which in a preferred embodiment is a Belleville washer that is positioned with the raised outer diameter facing away from the hanger ring 75. Another non-flat washer 52, also a Belleville washer, is positioned with the raised outer diameter facing toward the hanger ring 75.

Next is a pair of non-flat washers 52, which in a preferred embodiment are spring washers or curved disc spring washers, each having an inner diameter of about ½ of an inch, with an outer diameter of about 0.8 of an inch, and generally only require about 10 pounds of force to compress "flat." It will be appreciated that the dimensions of the spring washers may vary, depending upon the varying truck 20 assemblies and desired skateboard characteristics.

Next, is another pair of non-flat washers 52, preferably Belleville washers that are arranged with their outer diameters facing each other. Next is another pair of non-flat washers 52, preferably spring washers, and next is another pair of non-flat washers 52, preferably Belleville washers that are arranged with their outer diameters facing each other. Another pair of non-flat washers 52, preferably spring washers are next, with a final non-flat washer 52, preferably a Belleville washer, arranged with its outer diameter facing away from the hanger ring 75 completing the assembly.

FIG. 8B illustrates one arrangement of non-metal washers 54 and non-flat washers 52 that are preferably used on a front truck 20. Kingpin nut set 62 comprises an arrangement of non-metal washers 54 and non-flat washers 52 that are located between the kingpin nut 29 and hanger ring 75. In a preferred embodiment of the SSS 10, the front truck 20 uses the same kingpin nut set 62 as described above in connection with FIG. 8A.

In a preferred embodiment of the SSS 10 the truck base plate set 64 for the front truck 20 is different than the truck base plate set 64 used the rear truck 20. As shown in FIG. 8B, directly adjacent to the hanger ring 75 is a non-flat washer 52, which in a preferred embodiment is a Belleville washer that is positioned with the raised outer diameter facing away from the hanger ring 75. In a preferred embodiment, the Belleville washers used in the truck base plate set 64 for the front truck 20 have a different spring rate from the Belleville washers used in the truck base plate set 64 for the rear truck 20. For example, each Belleville washer may have an inner diameter of about ½ of an inch, an outer diameter of about 1 inch, with a curvature height and thickness that is different from the Belleville washers used on the rear truck 20. This is because in a preferred embodiment, the Belleville washers used on the truck base plate set 64 for the front truck 20 requires less than 173 pounds of force to compress about 0.030 of an inch. Instead, only about 170 pounds may be required to compress the Belleville washer about 0.030 of an inch.

Next is a pair of non-flat washers 52, which in a preferred embodiment are spring washers or curved disc spring washers. Next is a non-flat washer 52, which in a preferred embodiment is a Belleville washer that is positioned with the raised outer diameter facing toward the hanger ring 75. Next is a pair of non-flat washers 52, which in a preferred embodiment are spring washers or curved disc spring washers. Next is a non-flat washer 52, which in a preferred embodiment is a Belleville washer that is positioned with the raised outer diameter facing toward the hanger ring 75. Next is a pair of non-flat washers 52, which in a preferred embodiment are spring washers or curved disc spring washers. Next is a non-flat washer 52, which in a preferred embodiment is a Belleville washer that is positioned with the raised outer diameter facing toward the hanger ring 75. Another pair of non-flat washers 52, preferably spring washers are next, with a final non-flat washer 52, preferably a Belleville washer, arranged with its outer diameter facing away from the hanger ring 75 completing the assembly. This arrangement of non-flat washers 52 arranges several Belleville springs in the same direction, which adds their spring constant in parallel, creating a stiffer total spring rate (with the same deflection).

Figure 8C:
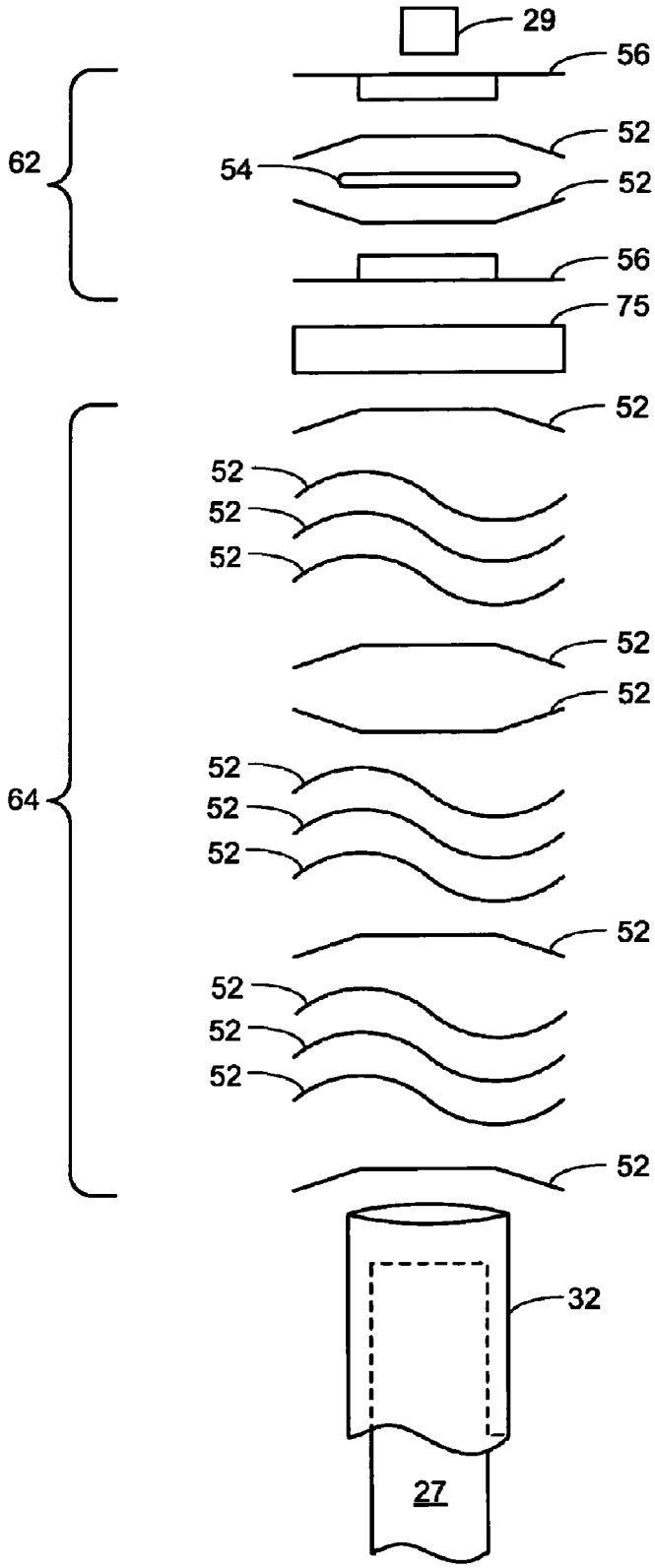
FIG. 8C is an exploded view of another embodiment of a king pin nut set and a truck base plate set for installation on a skateboard truck.

Referring now to FIG. 8C, other embodiments of non-flat washer 52 arrangements are encompassed by the SSS 10. For example, as shown in FIG. 8C, two of the Belleville washers are removed, and three spring washers are added. This embodiment may be installed on the rear truck 20 of the skateboard, and used on trucks 20 that have a larger, more massive hanger 90 that requires an additional "return-to-level" force. The arrangement for the front truck 20 is illustrated in FIG. 8B, but two additional spring washers are added, one to each pair closest to the hanger ring 75.

In another embodiment of non-flat washer 52 arrangements, the assembly of non-flat washers 52 may be the same on both sides of the hanger ring 75. That is, the truck base plate set 64 may replace the kingpin nut set 62, so that two truck base plate sets 64 are mounted on one truck 20. It will be appreciated that an almost limitless variety of non-flat washer 52 arrangements may be constructed, depending upon the design of the truck 20, or the desires of the skateboard operator. Therefore, the SSS 10 is not limited to the embodiments described herein, as any arrangement of non-flat washers 52, in combination with flat washers or other devices, is contemplated.

In a preferred embodiment of the SSS 10, the assembly of non-metal washers 54 and non-flat washers 52 varies between the front truck 20 and the rear truck 20. This is because most skateboards have a "front" and a "back." When the SSS 10 is installed on this type of skateboard, the assembly of non-metal washers 54 and non-flat washers 52 on the rear truck 20 will be "stiffer", or have a greater spring rate that the assembly of non-metal washers 54 and non-flat washers 52 on the front truck 20. However, on a skateboard that has no preferred "front" or "back" the assembly of non-metal washers 54 and non-flat washers 52 may not vary between the front truck 20 and the rear truck 20.

The above described SSS 10, as illustrated in the Figures, comprises several components. In a preferred embodiment, a complete SSS 10 comprises two planks 30, two kingpin sleeves 32, two pivot stem sleeves 42, and two assemblies of kingpin nut sets 62 and truck base plate sets 64, each comprising non-metal washers 54 and non-flat washers 52, with one set that is tailored to the rear truck 20, and another to the front truck 20. The SSS 10 may also include fasteners for coupling the trucks 20 to the planks 30, and coupling the planks 30 to the skateboard deck 15. Also, the SSS 10 may include four gap pads 55, with two coupling to each plank 30. It will be appreciated that various components of the SSS 10 may eliminated, such as the gap pads 55, or other components, and the assemblies of kingpin nut sets 62 and truck base plate sets 64, may be substantially identical for installation on skateboards that have no preferred "front" or "back."

The above described SSS 10, as illustrated in the Figures, provides several features. One feature is that the SSS 10 creates an optimum hanger 90 pivoting action, yet the thickness of the kingpin nut sets 62 and truck base plate sets, when compressed, create the desired stopping point for the hanger 90 pivoting action. In other words, when each kingpin nut set 62 and truck base plate set 64 is compressed, wheel bite is eliminated.

In addition, as mentioned above, the force generated when the non-flat washers 52 are compressed (by tilting the deck 15), expeditiously returns the deck 15 to "level" or out of a turn. This greatly increases the "crispness," handling, and safety of the skateboard as a conventional lazy-returning truck is both unstable and dangerous to ride.

The skateboard suspension system ("SSS") 10 of the present invention can be used on all lengths of skateboards. One embodiment is adapted toward "longboard" skateboards. The term "longboard" comes from the surfer's slang term for a surfboard which is generally more than nine feet long. Longboard skateboards are longer than traditional skateboards, and are usually at least three feet in length. With the added weight and length, longboard skateboards require not only different riding skills, but also different equipment to compensate for their unique size and shapes. For example, with a longer deck 15, the longboard skateboard does not perform optimally when using the same trucks that are used with traditional, twenty-four inch or less, skateboards due to "wheel bind." As discussed above, wheel bind occurs in longboard skateboards when the wheels contact the skateboard deck 15. Thus, longboard skateboards cannot turn sharply. Wheel bind also occurs in shorter skateboards as well, and one feature of the SSS 10 is that it eliminates wheel bind in all lengths of skateboards.

The "longboard" style focuses on cruising and "carving" turns, on skateboards having decks 15 longer than two feet. One feature of the SSS 10 is that once the SSS 10 is mounted or coupled to a skateboard, a rider can start out with a nominal amount of initial speed, (say 2 miles per hour) and not only maintain the initial speed but further accelerate to a significant amount of speed, (up to 10 mph) even up an inclined slope.

Thus, it is seen that a skateboard suspension system is provided. One embodiment comprises a skateboard kit for a skateboard comprising a skateboard deck and a skateboard truck. The skateboard kit comprises an extension member structured to couple to the skateboard deck, with a first section of the extension member positionable at an original skateboard truck mounting position on the skateboard deck, and a second section of the extension member comprising a new skateboard truck mounting position, with the second section angled relative to the first section so that when the skateboard truck is coupled to the new skateboard truck mounting position on the second section, the skateboard truck is positioned at an angle relative to the original skateboard truck mounting position and also located at a different skateboard deck location relative to the original skateboard truck mounting position.

The skateboard kit may include two extension members and the angle between the first section and the second section may range between 10 degrees and 30 degrees. Also, when the first section of the extension member is coupled to the skateboard deck, the second section is located adjacent to the skateboard deck thereby forming a space between the second section and the skateboard deck, and the second section deflects when a load is placed on the skateboard deck. At least one compressible element may be located between the second section and the skateboard deck.

The skateboard kit may further comprise a plurality of non-metal washers and a plurality of non-flat washers, with the plurality of non-metal washers and the plurality of non-flat washers positioned about a kingpin on the skateboard truck and structured to provide a rebound force when a portion of the skateboard truck is deflected.

Another embodiment comprises a skateboard kit for a skateboard comprising a skateboard deck and a skateboard truck that includes a truck base plate, a hanger, a kingpin, a kingpin retainer, a kingpin nut and a pivot stem. The skateboard kit comprises a first assembly comprising a plurality of non-flat washers sized to be positionable between the kingpin nut and the kingpin retainer and a second assembly comprising a plurality of non-flat washers sized to be positionable between the kingpin retainer and the truck base plate, where both the first and second assemblies are structured to provide a rebound force when the hanger is deflected.

In this embodiment each of the plurality of non-flat washers are selected from a group consisting of: a Belleville washer, a cupped spring washer, a spring washer, a conical spring washer, a wave washer, a disc spring, a curved washer, and a combination of two or more thereof. The kit may also include a substantially cylindrical kingpin sleeve sized to fit about the kingpin so that at least one of the plurality of non-flat washers contacts the kingpin sleeve and a pivot stem sleeve sized to fit about the pivot stem.

Yet another embodiment skateboard kit for a skateboard comprising a skateboard deck and a skateboard truck is provided. This embodiment skateboard kit comprises an extension member structured to couple to the skateboard deck, with a first section of the extension member positionable at an original skateboard truck mounting position on the skateboard deck, and a second section of the extension member comprising a new skateboard truck mounting position, with the second section including an angled surface so that when the skateboard truck is coupled to the new skateboard truck mounting position on the second section, the skateboard truck is positioned at an angle relative to the original skateboard truck mounting position and also located at a different skateboard deck location relative to the original skateboard truck mounting position.

The kit may include two extension members, where the angled surface ranges between 10 degrees and 30 degrees.

Thus, it is seen that a skateboard suspension system is provided. One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that many alternatives, modifications, permutations and variations will become apparent to those of ordinary skill in the art in light of the foregoing description.

For example, the plank 30 may be constructed about 3 inches shorter (6 inches instead of 9 inches), for installation on "short" boards, or "stubbies." This embodiment of the SSS 10 may also employ substantially identical assemblies of kingpin nut sets 62 and truck base plate sets 64 at the front and rear trucks 20. Another embodiment SSS 10 may use planks 30 that increase the action angle 65 by 19 degrees at both the front and rear of the skateboard.

Accordingly, it is intended that the present invention embrace all such alternatives, modifications and variations as fall within the scope of the appended claims. The fact that a product exhibits differences from one or more of the above-described exemplary embodiments does not mean that the product is outside the scope (literal scope and/or other legally-recognized scope) of the following claims.

For the purposes of interpreting words used in the claims, it is to be noticed that the term "comprising", should not be interpreted as being limitative to the claim elements listed thereafter. Thus, the scope of the expression "a device comprising elements A and B" should not be limited to devices consisting only of components A and B. It means that with respect to the present invention, the only relevant components of the device are A and B.

Similarly, it is to be noticed that the term "coupled" or "couple", as used in the claims, should not be interpreted only as meaning attached or joined together, and is not limitative to direct connections. Thus, the scope of the expression "an element A coupled to an element B" should not be limited to devices or systems wherein element A is directly connected to element B. It means that there exists a path between A and B which may be a path including other elements or means. In addition, when element A is "coupled" to element B, relative motion may be allowed between element A and element B.

It is to be understood that even though numerous characteristics and advantages of various embodiments of the present invention have been set forth in the foregoing description, together with details of the structure and function of various embodiments of the invention, this disclosure is illustrative only. In some cases, certain subassemblies are only described in detail with one such embodiment. Nevertheless, it is recognized and intended that such subassemblies may be used in other embodiments of the invention. Changes may be made in detail, especially matters of structure and management of parts within the principles of the present invention to the full extent indicated by the broad general meaning of the terms in which the appended claims are expressed.

What is claimed is:

1. A skateboard kit for a skateboard comprising a skateboard deck having an angled portion comprising a substantially parallel upward angled upper surface and angled lower surface, and a skateboard truck, the skateboard kit comprising:

an extension member structured to couple to the skateboard deck, with a first section of the extension member positionable at an original skateboard truck mounting position on the skateboard deck, and a second section of the extension member comprising a new skateboard truck mounting position, with the second section angled relative to the first section so that when the skateboard truck is coupled to the new skateboard truck mounting position on the second section, the skateboard truck is positioned at an angle relative to the original skateboard truck mounting position and also substantially aligned with the upward angled lower surface of the skateboard deck.

2. The skateboard kit of claim 1, where the kit comprises two extension members.

3. The skateboard kit of claim 2, where the angle between the first section and the second section ranges between 10 degrees and 30 degrees.

4. The skateboard kit of claim 1, where when the first section of the extension member is coupled to the skateboard deck, the second section is located adjacent to the skateboard deck thereby forming a space between the second section and the skateboard deck.

5. The skateboard kit of claim 1, where when the first section of the extension member is coupled to the skateboard deck, the second section is located adjacent to the skateboard deck thereby forming a space between the second section and the skateboard deck, and the second section deflects when a load is placed on the skateboard deck.

6. The skateboard kit of claim 5, further comprising at least one compressible element located between the second section and the skateboard deck.

7. The skateboard kit of claim 1, further comprising a plurality of non-metal washers and a plurality of non-flat washers, with the plurality of non-metal washers and the plurality of non-flat washers positioned about a kingpin on the skateboard truck and structured to provide a rebound force when a portion of the skateboard truck is deflected.

8. A skateboard kit for a skateboard comprising a skateboard deck having an angled portion comprising a substantially parallel upward angled upper surface and angled lower surface, and a skateboard truck, the skateboard kit comprising:

an extension member structured to couple to the skateboard deck, with a first section of the extension member positionable at an original skateboard truck mounting position on the skateboard deck, and a second section of the extension member comprising a new skateboard truck mounting position, with the second section including an angled surface so that when the skateboard truck is coupled to the new skateboard truck mounting position on the second section, the skateboard truck is positioned at an angle relative to the original skateboard truck mounting position and also substantially aligned with the upward angled lower surface of the skateboard deck.

9. The skateboard kit of claim 8, where the kit comprises two extension members.

10. The skateboard kit of claim 8, where the angled surface ranges between 10 degrees and 30 degrees.

* * * * *